US005526723A

United States Patent [19]

Sormunen et al.

[11] Patent Number: 5,526,723

[45] Date of Patent: Jun. 18, 1996

[54] STRIKING TOOL

[75] Inventors: Pertti Sormunen, Mönsterås; Hans Hortlund, Timmernabben, both of Sweden

[73] Assignee: Mutli CT AB, Monsteras, Sweden

[21] Appl. No.: 374,758

[22] PCT Filed: Jul. 27, 1993

[86] PCT No.: PCT/SE93/00641

§ 371 Date: Jan. 27, 1995

§ 102(e) Date: Jan. 27, 1995

[87] PCT Pub. No.: WO94/03309

PCT Pub. Date: Feb. 17, 1994

[30] Foreign Application Priority Data

Aug. 5, 1992 [SE] Sweden ..... 9202286

[51] Int. Cl.[6] ..... B25C 3/00; B25G 1/08

[52] U.S. Cl. ..... 81/487; 81/44; 81/177.4; 81/450

[58] Field of Search ..... 81/438, 439, 440, 81/450, 487, 44, 177.1, 177.4, 177.8

[56] References Cited

U.S. PATENT DOCUMENTS

| | | | |
|---|---|---|---|
| 640,696 | 1/1900 | Pearl . | |
| 1,200,158 | 10/1916 | Barrett | 81/487 |
| 2,691,908 | 10/1954 | Lamberth | 81/487 |
| 2,839,110 | 6/1958 | Carpenter | 81/44 |
| 3,935,762 | 2/1976 | Tudisco | 81/438 |
| 4,901,608 | 2/1990 | Shieh | 81/177.8 |
| 4,926,721 | 5/1990 | Hsiao | 81/177.4 |

FOREIGN PATENT DOCUMENTS

| | | | |
|---|---|---|---|
| 1266247 | 4/1968 | Germany . | |
| 2104815 | 3/1983 | United Kingdom | 81/177.8 |
| 2171342 | 8/1986 | United Kingdom . | |

*Primary Examiner*—Bruce M. Kisliuk
*Assistant Examiner*—Joni B. Danganan
*Attorney, Agent, or Firm*—Davis, Bujold & Streck

[57] ABSTRACT

The object of the present invention is to provide an ergonomical and practical, handle-equipped universal striking tool with exchangeable tool bits for use when center-punching, driving cotter pins and nail heads and driving in clips of various kinds, i.e. for such activities where today a hammer is used for striking a separate thumb-grip held object or separate, thumb-grip held tools. The problems with the earlier known technique are a.o. inferior accessibility, tool instability, inferior view, impact injury risks and overloading of the hand, and the problems of looking after a complete tool kit. This object is achieved in accordance with the present invention by a handle (1), which at least at one end is equipped with an at least in one plane pivotably arranged driver head socket (2), to which a driver head (3) is attached, said driver head socket being pivotably and lockably arranged in said handle. Exchangeable striking tool bits (10) for different work assignments are easily fitted to said driver head, and extra tool bits are magazined in said handle.

11 Claims, 3 Drawing Sheets

A - A
B - B
C - C

2(3)

STRIKING TOOL

BACKGROUND AND TECHNICAL FIELD

When working with conventional nail drivers, centre punches, mandrels and similar tools, intended for striking with a hammer, and when nailing various types of cable clips etc., one is confronted with a number of problems:

Limited access.

The tool (or the clip, the nail etc.) can only be held in a thumb grip.

The hand blocks the view of the tool and/or the object to be driven in and precision is impaired.

The lack of view and the instability of the tool make it easy to cause impact damage on the hand and on the object.

Stressing of hand muscles may—during prolonged work—cause occupational injuries.

By e.g. nail-drivers, centre-punches and other applications, each tool can only handle a very limited range of dimensions.

Problems are encountered in equipping oneself with, and looking after, a complete tool kit for a certain work assignment at hand, due to the many separate tools.

Some attempts have been made before to improve the situation. GB 2 171 343 A shows a centre punch mounted in a transversal bar that can be used as a handle for the centre punch, but the handle at the same time functions as a chuck wrench and is not very ergonomically shaped.

Also U.S. Pat. No. 640 696 shows a device where a centre punch or chaser punch has been equipped with a side handle. This tool is however shaped for one single, special purpose and solves very few of the problems listed above.

Furthermore, through DE B 1 226 247 a hand-held tool is known, having exchangeable tool bits attached in a fixed position at approximately right angles to the longitudinal axis of the handle. This device is however only intended for nail countersinking and is not equipped for universal use. Access is limited by all the nail drivers being attached at a fixed angle relative to the handle. Furthermore, only one nail driver at a time can be in a working position, which entails many manual operations when performing work where several sizes are needed. Finally, the device, due to it's design, can only be equipped with exchangeable tool bits having a working tip diameter that is smaller than their handle attachment end diameter.

SUMMARY OF THE INVENTION

The object of the present invention is to eliminate the problems which have been described in the beginning of this application and to provide an ergonomical and practical, handle-equipped universal tool, intended for receiving hammer blows and for using when centre-punching, driving cotter pins and nail heads, driving in nails and clips of various kinds, i. e. for all such activities where today separate thumb-grip held tools, struck by a hammer or similar, are used.

This object has been achieved in accordance with the present invention by a handle, being at least at one end equipped with a driver head fixed in a driver head socket, the latter being pivotably and lockably arranged in said handle. Into said driver head, exchangeable striking tool bits can be easily fitted, e.g. by means of threads, snap locks or similar.

The driver head/driver head socket assembly can pivot in at least one plane relative to the handle and can be locked in a number of different angular positions, all in order to achieve good accessibility, stability and visibility for the user when working in corners, from under, etc. In the embodiment example of the invention shown in the drawings, the pivoting and locking functions are achieved by means of a simple spring loaded "push-and-turn" (ratchet) device with a number of fixed locking positions, but other solutions are of course also conceivable within the scope of the invention, e.g. based on friction locking in any angular position through clamping, etc.

The driver head is so mounted in the driver head socket as to be replaceable in case of excessive wear or damage. As the handle is equipped with driver heads at both ends, and equipped with magazines for at least two additional tool bits, the user can equip himself with, and easily look after, at least four tool bits for a certain work assignment.

The number of types of tool bits can be adapted to the customer demands. Among the basic types one may easily imagine centre punches, nail drivers and mandrels of various dimensions, as well as combined holders/nailing tools for various clips and clamps intended for fastening of different types of electrical cables, fence wires, etc.

The division of the striking tool into a handle part with an attached driver head, and tool bits fitted from below into the driver head, entails that the size of the working tip area of the tool bit is not limited by the cross section area of the driver head, but can have a suitable size and shape, adapted to it's task.

DETAILED DESCRIPTION OF AN EMBODIMENT EXAMPLE OF THE INVENTION

The invention will be described below with reference to a non-limiting embodiment example depicted in the drawings, in which.

The embodiment example shown in the figures in order to describe the device according to the invention, comprises two driver head sockets 2, which in the described embodiment are assembled at each end of a handle 1, said handle in turn consisting of two identical handle halves 17. In the example, the handle halves are joined together by screws and nuts located in therefore intended holes 18. Other joining methods may of course be foreseen, such as e.g. snap locks based on the elasticity of the material from which the handle halves are made.

Figures 1, 2, 3, 4, 5, 6:
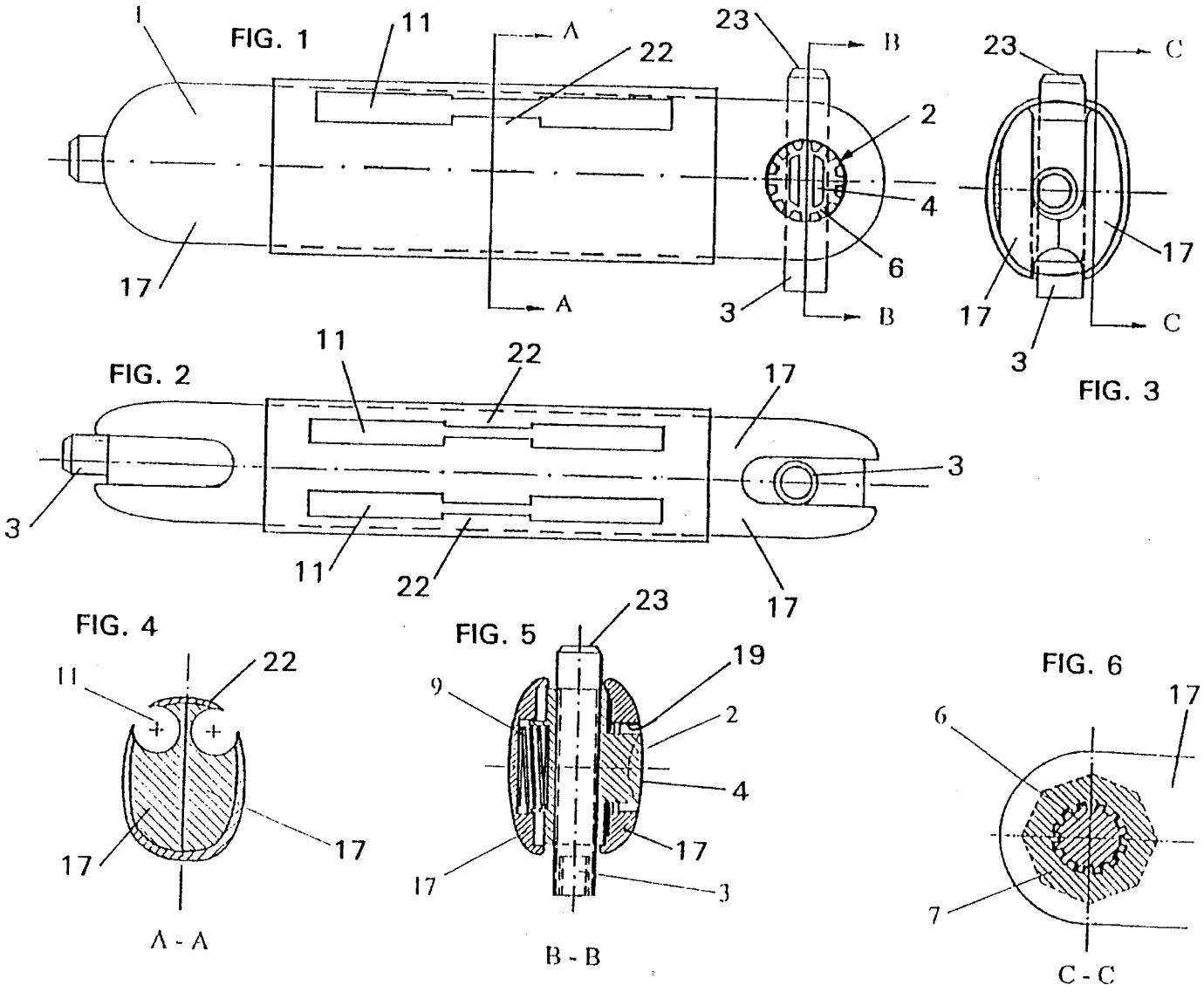
FIGS. 1–3 depict an assembled universal tool, without attached tool bits, in plan view, side view, and end view, respectively.
FIG. 4 is a cross section through a tool handle with tool bit magazines taken along line A—A in FIG. 1.
FIG. 5 is a cross section through a handle and a driver head socket arranged at one end of said handle taken along line B—B in FIG. 1.
FIG. 6 is a longitudinal section through a handle and a driver head socket taken along line C—C in FIG. 3, placed at right angles to section B—B and through the toothed wheel rim of the driver head socket.
Figure 7:
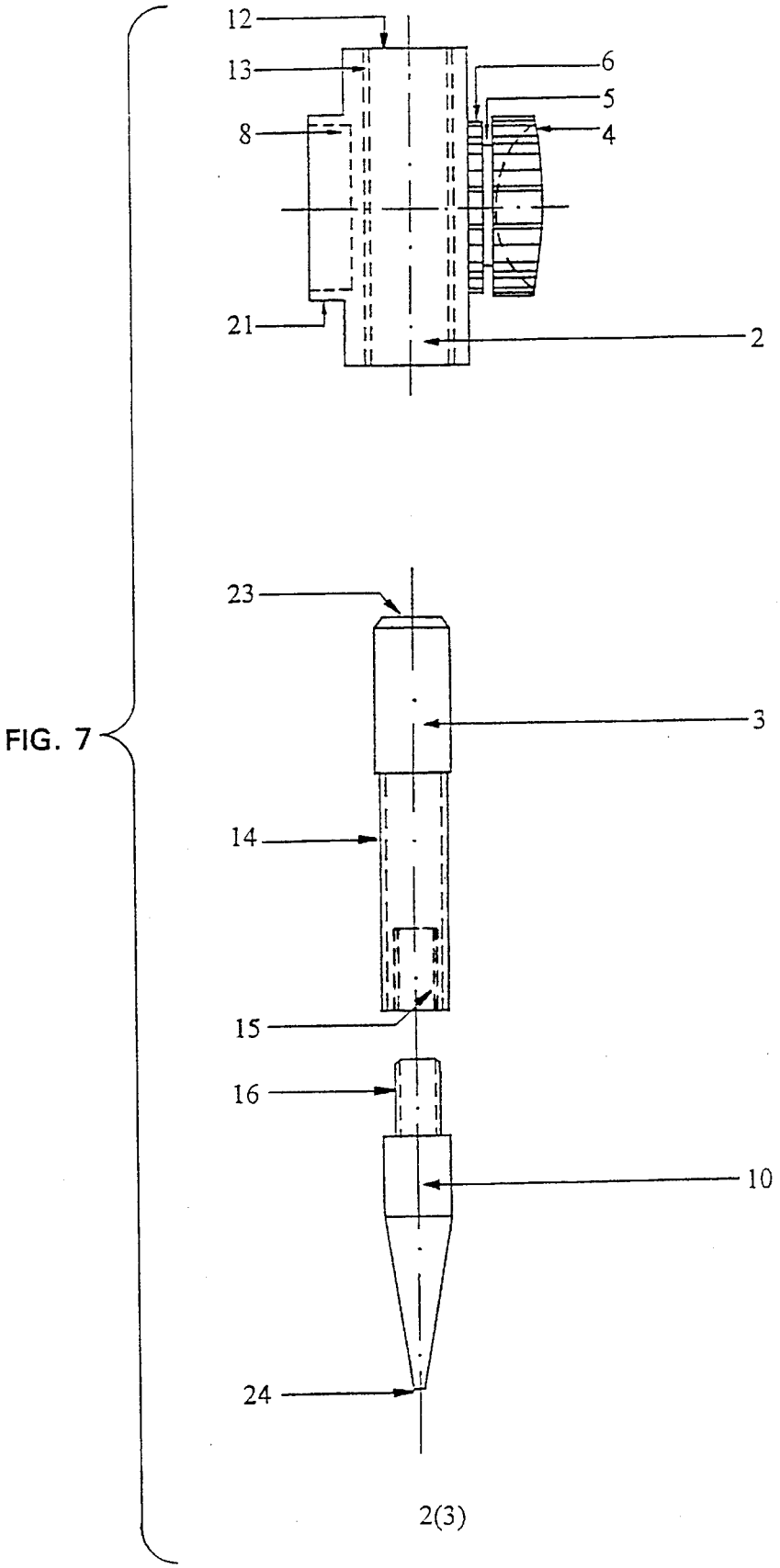
FIG. 7 depicts an embodiment example of a driver head socket, a driver head and a tool bit, all shown in an exploded side view.
Figure 8:
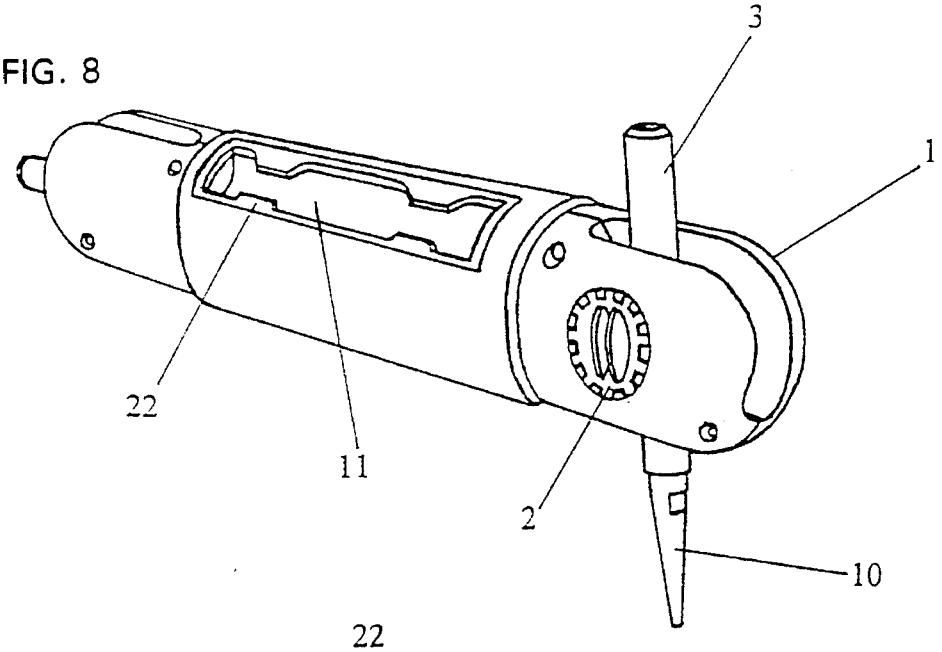
FIGS. 8–10 depict a perspective view of a complete universal tool and perspective views from two directions of a tool handle half, respectively.
Figure 9:
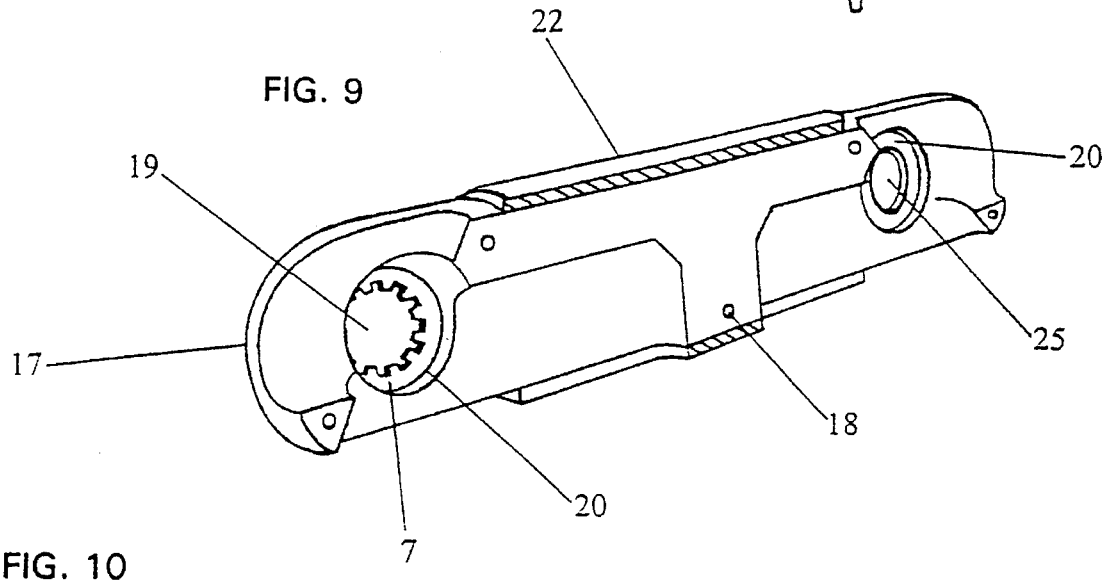
Figure 10:
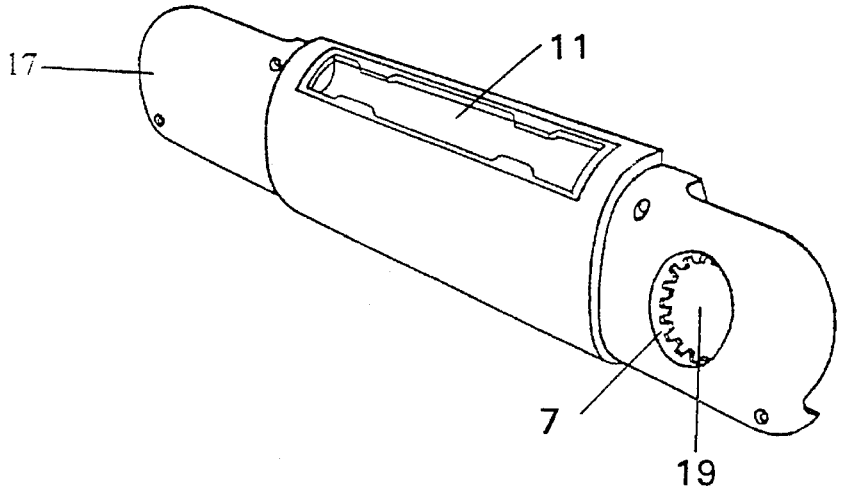

The driver head socket 2, see FIG. 2, is moulded in one piece from e.g. a suitable plastic material, and one end of it is shaped as a cylindrical push-and-turn knob 4, also functioning as an axle neck. Inwards from said knob are in turn located a clearance groove 5 and a toothed wheel rim 6. The centre portion of the driver head socket is an equally cylindrical driver head housing 12 with a fastening device, in the present example designed as a diametral hole with a thread, 13, for attachment of a driver head, 3. On the other side of the driver head housing there is a second axle neck 21, internally shaped like a spring housing 8.

Said axle neck 21, with it's spring housing 8 and a coil spring 9 located therein, is pivotably and axially displaceably lodged in an axle neck recess 25 at one end of one of the handle halves 17, whereby said driver head housing 12 fits into a cylindrical recess 20, concentrically located around the axle neck recess 25. The cylindrical push-and-turn knob/axle neck 4 is in a corresponding manner lodged in a cylindrical hole 19 in the corresponding end of the other handle half 17, whereby said knob 4 lies outside of a sparsely toothed washer 7, moulded into this end of said handle half 17, and being in engagement with the toothed wheel rim 6 of the driver head socket 2, due to the force of the spring 9. See FIG. 1, sections B—B and C—C. The driver head socket 2 is in this way locked against pivoting relative to the handle 1, thus giving the driver head 3, which is fitted in the driver head socket, a securely fixed position. Said driver head can thus be simply and securely held by the handle 1, with it's exchangeable tool bit 10 against the work piece, while a hammer is used for striking it's impact area 23. Other embodiments of the details of this pivoting lock device are of course conceivable within the scope of this invention, thus the toothed washer may be replaced by teeth moulded directly into the handle half, and an entirely different, stepless locking device is also conceivable, based upon friction clamping between the handle halves 17 and the driver head socket 2. Such a solution is especially suitable if a striker head pivoting in more than one plane relative to the handle, is wanted.

If a finger is used to push axially on the knob 4, the whole striker head socket 2, with the attached striker head 3 and tool bit 10, is displaced axially, whereby the spring 9 is compressed and the axle neck 21 will reach the bottom of the recess 25. The clearance groove will hereby be aligned with the sparsely toothed washer 7, whereby the locking between the handle 1 and the striker head socket 2 is freed and said socket can now be turned to a new position relative to the handle. When the approximate wanted position is reached, the pressure on the knob 4 is released while continuing to turn the striker head socket 2 in either direction, whereby the force from the spring 9 will snap the toothed wheel rim 6 into the first available tooth gap of the toothed washer 7, thus locking the driver head socket 2 with the driver head 3 and the exchangeable tool bit 10 in a wanted new working position relative to the handle 1.

The two handle halves 17 are in the present embodiment example completely identical in shape. This entails that when two handle halves are turned against each other during assembly, two identical mounting locations, each for one driver head socket, are created, one at each end of the handle 1.

Each handle half 17 has in it's centre portion a recess, a so called bit magazine 11, in which tool bits 10 not presently in use may be placed and held by a holding device 22, in the shown embodiment example designed as relatively supple, elastic tabs made from a plastic material, past which a tool bit may be pushed by finger force but not pass by it's own weight. Every universal tool according to the invention can thus hold up to four tool bits 10; two in the bit magazines 11 and two fitted into the driver heads 3, which makes it easy for the user to bring along and look after several tools for a work assignment demanding more than one striking tool.

The tool bits 10 used when working with the present device can have a shape completely adapted to their use and are completely independent of the dimensions of the driver head 3, except for the attachment portion 16 which must fit into the corresponding device 15 of said driver head. In the shown embodiment example, the tool bit 10 is equipped with an externally threaded stud 16 which can be screwed tight into a corresponding, internally threaded hole 15 in the driver head 3. Other attachment devices are of course conceivable within the scope of this invention, e.g. based on snap-locking or friction.

In summary, the device according to the present invention provides a universally applicable, handle-equipped striking tool, by which the driver head can be aimed, and comfortably and safely held, in a multitude of directions for good accessibility and visibility during the work, said tool being able to hold tool bits being adapted to and specially designed for a multitude of varying work assignments of the striking/driving type, alone or in combination with holding the object that is being driven in by means of e.g. a hammer via said driver head and tool bit.

We claim:

1. A device, for holding and aligning an impact tool subjected to impact forces in a longitudinal axial direction, comprising:

two identically shaped elongate handle halves (17);

each said handle half (17) having: a driver head socket (2) pivotally mounted to one end thereof, for pivotal motion in at least one plane, and a driver head (3), mounted in the driver head socket (2), for selectively pivotally mounting a desired impact tool bit (10) to said handle;

said handle halves (17) being mounted together, with one of the handle halves (17) turned 180 degrees relative to the other of the handle halves (17) forming an elongate handle (1) having a said driver head socket (2) located at each end thereof.

2. A device according to claim 1, wherein said driver head comprises: an impact area on a first end thereof; a mounting device on a middle portion thereof, for mounting the driver head to a corresponding said driver head socket; and an attaching device on a second end thereof, remote from the first end, for facilitating attachment and removal of a desired one of a plurality of exchangeable said tool bits (10).

3. A device according to claim 2, wherein each of the plurality of exchangeable tool bits (10) has a quick attachment device (16) at one end thereof, for attaching the tool bit to the attachment device of the driver head (3), and a tooling surface (24) at the other end thereof.

4. A device according to claim 1, wherein the at least one pivoting plane of each of the driver head sockets (2) coincides with a longitudinal axis of the handle (1).

5. A device according to claim 1, wherein each of the driver head sockets (2) selectively lock at different angles relative to the handle (1).

6. A device according to claim 1, wherein the handle (1) is equipped with magazines (11) with retaining devices (22) for retaining the tool bits (10) in the magazine (11).

7. A device, for holding and aligning an impact tool subjected to impact forces in a longitudinal axial direction, comprising:

a handle (17) having a driver head socket (2) pivotally mounted in a recess (19, 25) in at least one end of the handle (1) for pivotal motion in at least one plane, and a driver head (3) mounted in the driver head socket (2) for selectively pivotally mounting a desired impact tool bit (10) to said handle;

wherein the driver head socket (2) comprises first (4) and second (21) axle necks extending from opposite sides of the driver head socket along a pivoting axis of the driver head socket (2), the first axle neck defining a push-and-turn knob (4) having a toothed rim (6), the second axle neck (21) has an axial recess therein defining a spring housing (8); and a spring is compressed between a bottom surface of the spring housing (8) in the driver head socket (2) and a bottom surface of the recess (25) in the handle (1), for biasing the driver head socket away from the recess (25) in the handle and engaging the toothed rim (6) on the first axle neck with corresponding teeth (7) fixedly provided on an inner peripheral surface of the recess (25) in the handle (1), thereby to pivotally lock the driver head socket in a desired position, the toothed rim (6) on the driver head socket and the teeth (7) in the handle (1) are provided with axial lengths such that, when the knob (4) is depressed inward relative to the recess (25), in opposition to the spring, the driver head socket moves inwardly relative the recess (25) and the toothed rim (6) on the driver head socket disengages the teeth (7) in the handle (1), such that the driver head socket (2) may be freely pivoted into a new desired position by turning the knob (4), and upon release of the knob (4) the toothed rim (6) reengages the teeth (7), pivotally locking the driver head socket (2) in the new desired position.

8. A device according to claim 7, wherein said driver head comprises: an impact area on a first end thereof; a mounting device on a middle portion thereof, for mounting the driver head to a corresponding said driver head socket; and an attaching device on a second end thereof, remote from the first end, for facilitating attachment and removal of a desired one of a plurality of exchangeable said tool bits (10).

9. A device according to claim 8, wherein each of the plurality of exchangeable tool bits (10) has a quick attachment device (16) at one end thereof, for attaching the tool bit to the attachment device of the driver head (3), and a tooling surface (24) at the other end thereof.

10. A device according to claim 7, wherein the at least one pivoting plane of each of the driver head sockets (2) coincides with a longitudinal axis of the handle (1).

11. A device according to claim 7, wherein the handle (1) is equipped with magazines (11) with retaining devices (22) for retaining the tool bits (10) in the magazine (11).

* * * * *